US010035571B1

(12) United States Patent
Langlois

(10) Patent No.: US 10,035,571 B1
(45) Date of Patent: Jul. 31, 2018

(54) SYSTEM FOR ATTITUDE CONTROL AND STABILIZATION OF A MARINE CRAFT

(71) Applicant: Joseph R. Langlois, Coral Springs, FL (US)

(72) Inventor: Joseph R. Langlois, Coral Springs, FL (US)

( * ) Notice: Subject to any disclaimer, the term of this patent is extended or adjusted under 35 U.S.C. 154(b) by 0 days.

(21) Appl. No.: 15/681,932

(22) Filed: Aug. 21, 2017

Related U.S. Application Data

(63) Continuation-in-part of application No. 14/997,244, filed on Jan. 15, 2016, now abandoned.

(51) Int. Cl.
*B63B 1/22* (2006.01)
*B63B 39/06* (2006.01)

(52) U.S. Cl.
CPC ..... *B63B 39/061* (2013.01); *B63B 1/22* (2013.01)

(58) Field of Classification Search
CPC ..... B63B 39/061; B63B 1/22
USPC ..... 74/104; 114/284, 285
See application file for complete search history.

(56) References Cited

U.S. PATENT DOCUMENTS 3,371,642 A * 3/1968 Joy ..... B63B 39/061 114/285
3,399,643 A * 9/1968 Bennett ..... B63B 39/061 114/285
3,463,109 A * 8/1969 Weiler ..... B63B 39/061 114/286
3,628,487 A * 12/1971 Bennett ..... B63B 39/061 114/287
3,678,874 A * 7/1972 Flink ..... B63B 1/22 114/285
3,977,349 A * 8/1976 Hummel ..... B63B 39/061 114/287
4,896,622 A * 1/1990 Thomas ..... B63B 39/061 114/271
4,909,175 A * 3/1990 Arnseson ..... B63B 39/061 114/285
4,967,682 A * 11/1990 O'Donnell ..... B63B 39/061 114/286
6,167,830 B1 * 1/2001 Pilger ..... B63B 39/061 114/285
7,188,581 B1 * 3/2007 Davis ..... B63B 39/061 114/285

(Continued)

*Primary Examiner* — Anthony D Wiest
(74) *Attorney, Agent, or Firm* — Melvin K. Silverman

(57) ABSTRACT

A system for attitude control and stabilization of a marine craft includes at least one elongate substantially planar surface, which may be rigid or flexible, disposed on either side of and in substantial alignment with a bottom of the planing hull of the marine craft. The elongate surface, in a rigid form, includes a tongue-like distal end slidably captured as a fluid hinge upon a region of the hull about 2 to 8 feet forward of the transom. In a flexible form, a distal end of the elongate planar surface may be secured directly to the hull. The elongate surface further includes an actuation portion proximal to a transom of the craft. The system also includes an actuator selectably slidable and securable within an actuation sleeve, the sleeve secured to the transom of the craft. Also included in the system are elements, manual, hydraulic or electrical, for selectably advancing the actuator relative to the hull to induce a selectable angulation of the elongate planar surface relative the bottom of the hull of the craft.

14 Claims, 23 Drawing Sheets

(56) References Cited

U.S. PATENT DOCUMENTS

| | | | | |
|---|---|---|---|---|
| 7,216,601 | B1 * | 5/2007 | Mann | B63B 1/32<br>114/285 |
| 2008/0257247 | A1 * | 10/2008 | Crews | B63B 39/061<br>114/285 |

* cited by examiner

SYSTEM FOR ATTITUDE CONTROL AND STABILIZATION OF A MARINE CRAFT

CROSS REFERENCE TO RELATED APPLICATIONS

This application is a continuation-in-part and claims the benefit under 35 USC 119(e) of co-pending patent application Ser. No. 14/997,244, filed Jan. 15, 2016, which is a continuation-in-part of patent application Ser. No. 14/825,804, filed Aug. 13, 2015, now abandoned, which is also a provisional application of Patent Ser. No. 62/036,950, filed Aug. 13, 2014. All prior patent applications are herein incorporated by reference in their entirety.

FIELD OF THE INVENTION

The present invention relates to an improvement in classical trim-tab technology to enhance the general hydrodynamic performance of a marine craft inclusive of the fuel efficiency thereof.

BACKGROUND OF THE INVENTION

So-called boat leveling devices of the trim-tab type have been known for many years and various forms of them have been developed in an effort to maximize attitude control, stability of the marine craft and general hydrodynamic efficiency inclusive of decrease of flow velocity under the hull and fuel efficiency.

The prior art trim-tabs which typically are provided in pairs to enhance stability of the craft, is shown in FIGS. 1, 2, 3 and 4 herewith. More particularly, FIG. 1 shows a traditional external trim-tab 2.1 of which is attached directly to transom 3.1 of a craft 100.1 and in which the attitude of the trim-tab is controlled through a hydraulic piston assembly 4.1 which controls relative angulation of the hull relative to level of the water. Also shown in FIG. 1 is a servo-loop wiring 9.1 by which assembly 4.1 are controlled.

The prior art shown in FIG. 2 differs from that of FIG. 1 only in that the trim tab 2.2 is positioned beneath stern 6.2 of the craft 100.2 and forward of propeller 8.2. Therein, the direction of assembly 4.2 and hydraulic piston 5.2 are aligned with the gravity vector as opposed to the angled position of the hydraulic assembly shown in the prior art of FIG. 1.

The prior art shown in FIG. 3 demonstrates the hinge common in most trim tabs, that is, a pivot hinge 1.3 that fastens the planar surface 2.3 of the trim tab to the watercraft. The pivot hinge is fixed in a specific location, and requires an actuator 5.3, mounted at an non-right angle to allow the planar surface to descend.

The prior art shown in FIG. 4 shows a similar issue where the planar surface 2.4 is fastened directly to the hull of the watercraft by a living hinge 7.4. This living hinge 7.4 is in a fixed location as well, and thus requires an actuator 5.4 mounted at a non-right angle, or the actuator 5.4 with a pivot mount to allow the planar surface 2.4 of the trim tab to descend.

In general trim-tabs of the prior art, whether double or single acting, will operate upon the same principles and have a common objective, namely, that of contributing to the efficiency control of the boat's attitude, stabilization and general hydrodynamics.

There are significant differences between the prior art and the current invention. Primarily, the use of a living hinge as in the prior art of Arnseson U.S. Pat. No. 4,909,175 and Weiler, U.S. Pat. No. 3,463,109, do not allow an extent of slidability for the trim tabs it connects. Arnseson uses a living hinge 7.4, which is a thin flexible hinge made from the same material as the two rigid pieces it connects. Weiler uses a pivot hinge 1.3, which allows its trim tab 2.3 to raise and lower, but is limited to pivoting around its connection point. Thus, there exists a need for a fluid-hinge to allow slidability of the trim tab it connects.

In recent years, most efforts of the prior art have been directed primary to improvement of the electronics and the development of algorithms to optimize trim-tab control under various conditions of vehicle speed, wave conditions, shape of the boat's hull, having distribution in craft, and other hydrodynamic considerations. The prior art also has experimented with the efficiency of electric motor controls of the trim tabs as opposed to that of the hydraulic systems shown in FIGS. 1 and 2. In general, the durability of electric motor controls have proven to be superior than that of hydraulic actuators.

The U.S. Navy has undertaken significant research and development in this area to attempt to maximize performance of a variety of its boats and, typically, of the types employed by the U.S. Coast Guard. In Navy terminology, a trim-tab is referred to as a stern flap, apparently because its engineering objectives are more ambitious than are the case with a leisure class powerboat. More particularly, the Navy has identified the following criteria as hydrodynamic mechanisms which account for improved boat performance based on optimized stern flap design.

After Body Flow Modifications:
Flow velocity under the hull decreased.
Pressure recovery increased.
Transom exit velocity increased.
Wave System Modifications:
Localized transom system wave system altered.
Near field wave heights reduced.
Far field wave energy reduced.
Secondary Stern Flap Hydrodynamic Effects:
Ship length increased.
Beneficial propulsion interactions.
Ship trim modified (bow down trim induced).
Ship sinkage is reduced.
Lift and drag forces developed on flap.

The within inventor has recognized that the fundamental objectives and benefits of trim tabs and stern flaps may be more effectively achieved if the entire length of the trim-tabs or stern flaps are extended. And that, when properly actuated and controlled, such elongated attitude control element, as suggested can accomplish and substantially improve upon the performance of prior art trim tabs and stern flaps regardless of hydrodynamic conditions. The efficiency of the present invention may be yet further improved the assistance of contemporary electronic controls and algorithms. The present invention also improves upon efforts that seek to improve the performance of trim tabs thereof through modification of their geometry as, for example, is reflected in U.S. Design Pat. No. 292,392 (1987) to Zepp, entitled Boat Leveler Twin Tab; U.S. Pat. No. 6,038,995 (2000) to Karafiath et. al, entitled Combined Wedge-Flap; and U.S. Pat. No. 3,092,062 (1963) to Savitsky entitled Mechanical Control for Submerged Hydrofoil Systems.

SUMMARY OF THE INVENTION

The instant invention relates to a system for attitude control, inclusive of stabilization of a marine craft. The system includes at least one elongate substantially planar surface disposed on either side of and in substantial alignment with or parallel to a bottom of the planing hull of the craft. In a rigid or flexible embodiment, said elongate surface includes a tongue-like distal end confined within a fluid hinge slidably captured upon a region of the hull at about 2 to 8 feet forward from the transom. The slidability allows the trim tab to rest about horizontally at low speed or no speed, but allows the trim tab to move and slide as required with raising and lowering the trim tab.

The system further includes said fluid hinge having a male and a female element of engagement, wherein said female element comprises a fluid hinge receiver acting as a pocket to capture a distal end of each elongate, and said male element comprises the distal end of each elongate, wherein said pocket contains the distal end of each elongate close to the hull, and said distal end of each elongate lacks a physical fastening to the hull. Further, said distal end of each elongate has forward slidability and aft slidability substantially within said pocket.

The system further includes an actuator proximal to a transom of the craft, in which the actuator urges against the elongate planar surface downwardly relative to the plane of hull. The actuator is selectably slidable and securable within an actuation sleeve, the sleeve secured to the transom of the craft. Further included in the system are means, either manual, hydraulic or electrical, for selectably positioning the actuator relative to the sleeve to induce a selectable angulation of a proximal portion of the elongated planar surface to thereby adjust the plane of said elongate planar surface relative to a plane defined by the bow-to-stern of the craft.

It is accordingly an object of the present invention to provide an improved trim tab system which overcomes the various hydrodynamic limitations of the prior art, the same having utility with leisure as well as naval vessels.

It is another object of the invention to provide a trim tab system capable of inducing a greater change in bow-to-stern or glide angle angulation of the marine craft relative to the water level while increasing the fuel efficiency thereof.

It is a yet further object to provide a system of the above type which furnishes improved accuracy of adjustment versus prior art trim tab stern flap systems.

It is a further object to provide a system of the above type having utility in improved performance of marine craft whether used in a single or double trim tab context.

It is a still further object to provide a system to improve the degree and control of the glide angle of the watercraft and its ability to correct uplift zones to facilitate a more favorable weight distribution, each resulting in reduced fuel costs.

Yet further, the present invention also seeks to reduce the need for submersible flow interceptors as they are know in the art.

Still further, the present invention therefore seeks to provide more effective trimming coupled with the greatest possible uplift and lowest water resistance values, both at slow and high speeds, in a manner that does not substantially complicate the kinematics of prior art attitude control systems.

The present invention also seeks to increase efficiency of removing and replacing a trim tab, for various reasons including replacement and cleaning, by allowing the user to disconnect the actuator from the trim tab, and slide the trim tab out of the capture of the fluid hinge, and thereby lessoning time-consumption and damage to the watercraft or trim tab due to removal as a result.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 6:
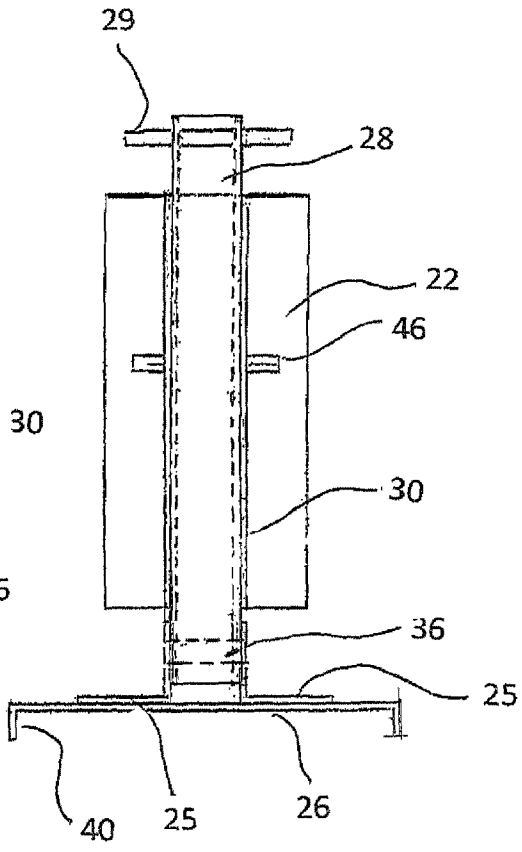
FIG. 6 is a stern end view of the illustration of FIG. 5.
Figure 5:
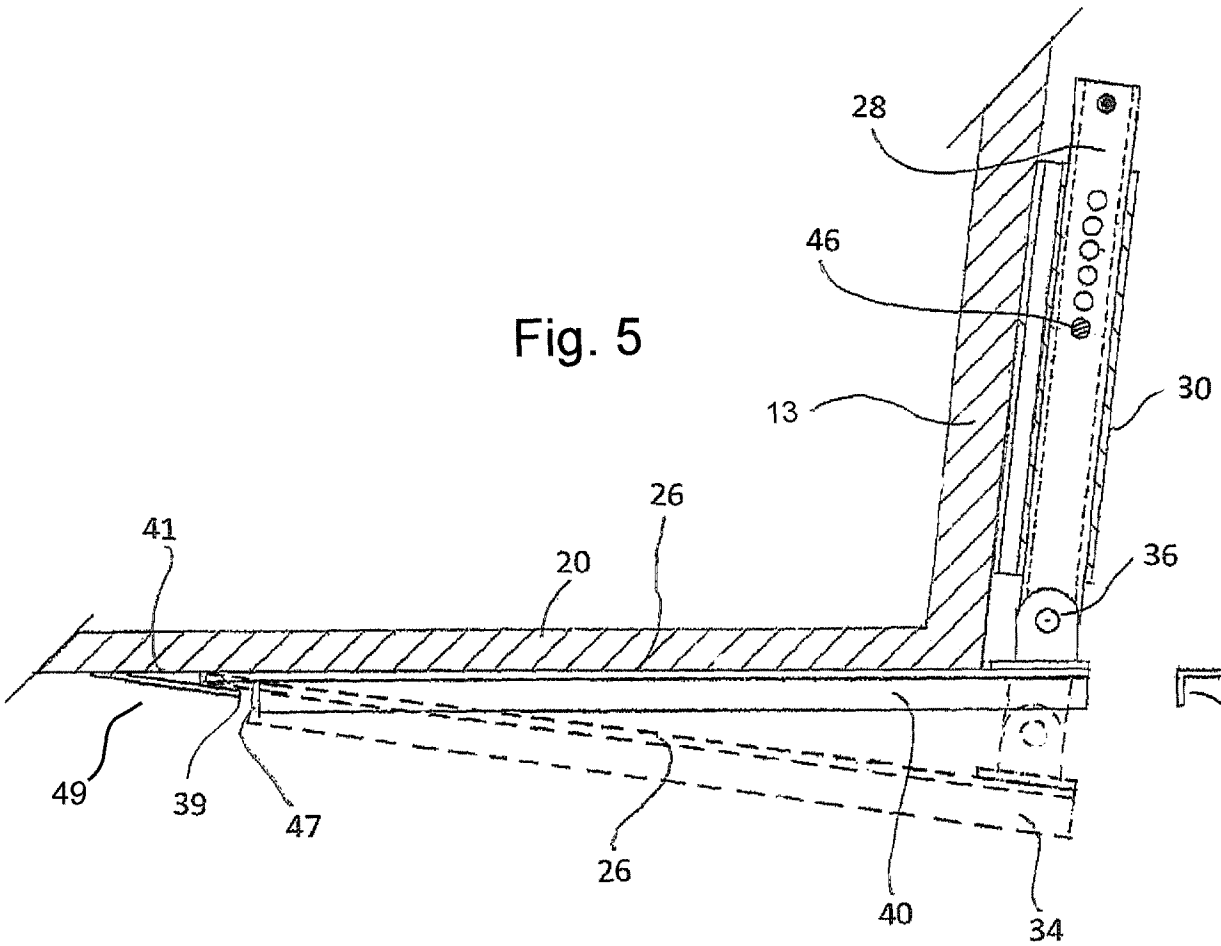
FIG. 5 is a schematic side elevational view showing one embodiment of my system including its glide angle adjustment capability.

With reference to the schematic views of FIGS. 5-6, the stern and mid-hull elements of a first embodiment the invention are shown. More particularly, a craft may be seen to include a hull 20 and transom 13 to which is secured a vertical plate 22 which extends downward and behind an actuation sleeve 30. Within actuation sleeve 30 is actuator 28 which urges downwardly against an elongate planar attitude control surface, also referred to herein as tab 26. It may be seen in FIGS. 5, 7, 10 and 11. The attitude control surface may be either rigid or flexible, the flexible surface indicated as element 126, in FIG. 9.

In the manually operated embodiment of the present system, handle 29 is employed to advance actuator 28 downward to a desired aperture 46 at which a transverse bar portion of the handle is employed to establish a fixed location tab 26 below the hull of the boat. Typically, said surface is adjustable in a range of about zero to a maximum of about 30 degrees relative to the hull of the boat, this may be seen in FIGS. 5 and 9. The structure of FIG. 6 may be seen in exploded view in FIG. 11.

Figures 16, 17:
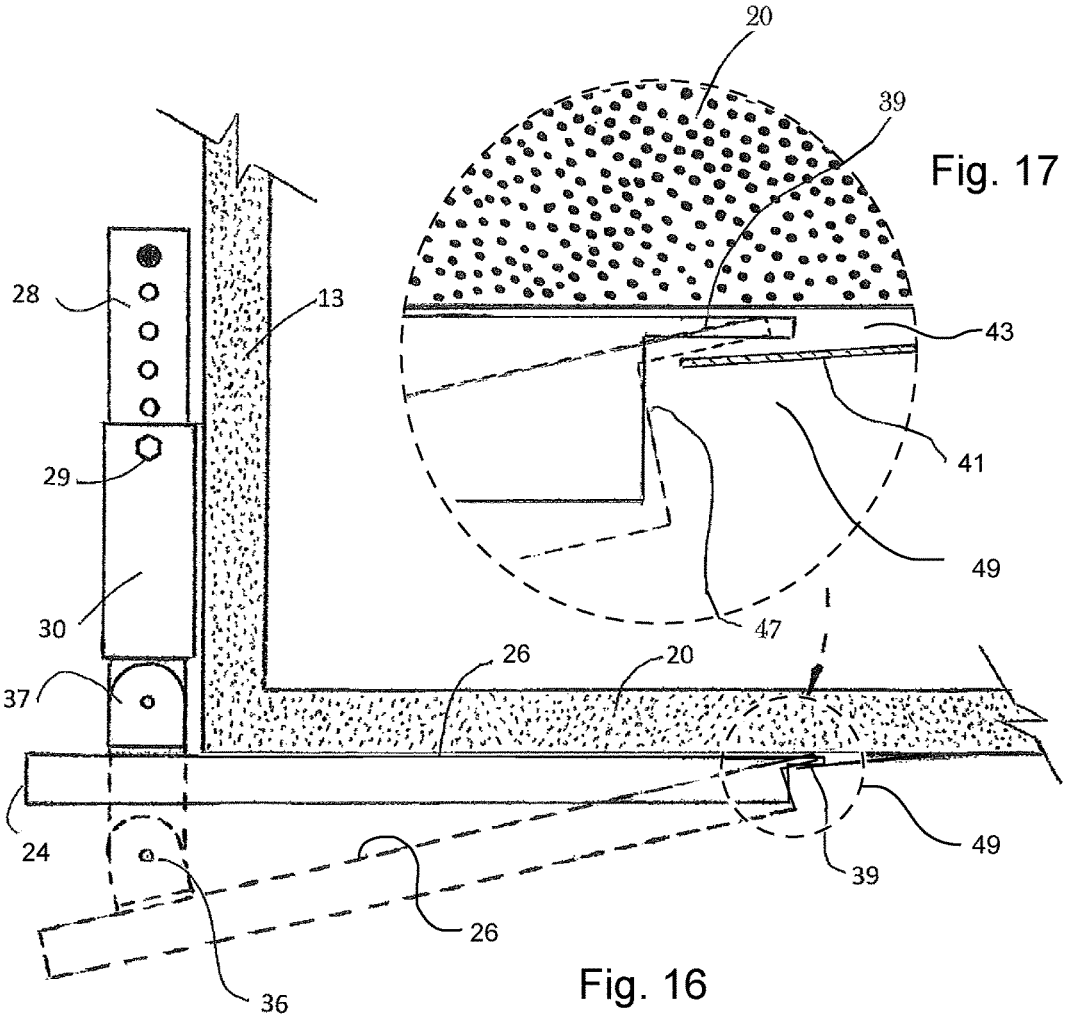
FIG. 16 is a sequential view showing the operation of the actuation of the tab of the system of FIG. 15.
FIG. 17 is an enlarged view of the fluid hinge portion of FIG. 16.

The tab or elongate planar attitude central surface 26 more particularly includes a distal tongue-like element 39 which is held by a fluid hinge receiver 41 which is secured at a distal area to hull 20 of the boat. Thereby, as for example is shown in FIGS. 16 and 17, said elongate surface 26 is slidably held to the hull 20 by a fluid hinge receiver 41. This combination of a distal tongue-like element 39 and fluid hinge receiver 41 make up the fluid hinge 49.

The definition of tongue used in this application is "the rib on one edge of a board that fits into a corresponding groove in an edge of another board." The use of the word "like" indicates that this tongue is applied to a trim tab. A "distal tongue-like element" as can be seen in FIGS. 5, 16, 17, and 18.

The term "fluid" used in this application, and as taken from Oxford Dictionaries indicates: not settled or stable; likely or able to change. As such, the fluid hinge 49 as defined indicates a hinge that is likely or able to change and is not stable or settled. The planar surface of the trim tab needs to move and slide up and down, as well as forward and aft, in order to allow the actuator to move and slide the planar surface up and down. This level of fluidity indicates that the hinge comprises a non-coupled connection. The term "coupled" means to fasten, link, or associate. This term is counter to the ability to change, and thus, the term fluid-hinge 49 is analogous to a non-coupled connection, that is, the fluid hinge 49 allows movement of the distal tongue-like element 39, but does not physically fasten or couple the tongue like element to any surface. Instead, the fluid hinge receiver 41 acts like a pocket 43 to capture or contain the tongue-like element from falling out of the pocket 43. The term non-coupled refers to the properties of the fluid hinge 49 that allow the planar surface to rest at low or no speed, but does not restrict the motion needed from the slidability and movement of the planar surface between raised and lowered positions of the rear of the trim tab. Such movement and sliding would not be allowed in any of the prior art references.

In other words, the fluid hinge 49 as shown in FIG. 17 shows that the pocket 43 acts as a hinge to contain the planar surface, but the connection between the distal tongue 39 and the fluid-hinge receiver 41 is not physically connected or fastened, as shown in FIG. 17, which further shows the changing angle of the planar surface, and any fastening of the planar surface to any other surface depicted therein would have the affect of rendering this invention inoperable, as an extent of "fluidity" is necessary to allow the planar surface to move and slide depending on angle. These figures indicate that the front of the trim tab lacks a securement of planar surface or fastening to another surface, opposite of the prior art as shown in Arnseson.

A non-fastened/non-coupled connection of a fluid-hinge 49 indicates that the planar surface can physically move freely and slide, i.e. change angle from that of the hull, without breaking or substantially deforming the planar surface. Notice in FIGS. 5, 16, 17, and 18 the space provided above and/or below the planar surface. Also notice that there are no places or elements on the tongue 39 in which a fastening element exists.

FIG. 5 is a schematic side elevational view showing one embodiment of the system including its glide angle adjustment capability. Notice how the tongue 39 of the planar surface 26 does not take up the whole pocket 43, and in fact, requires the ability to move and slide.

Figure 15:
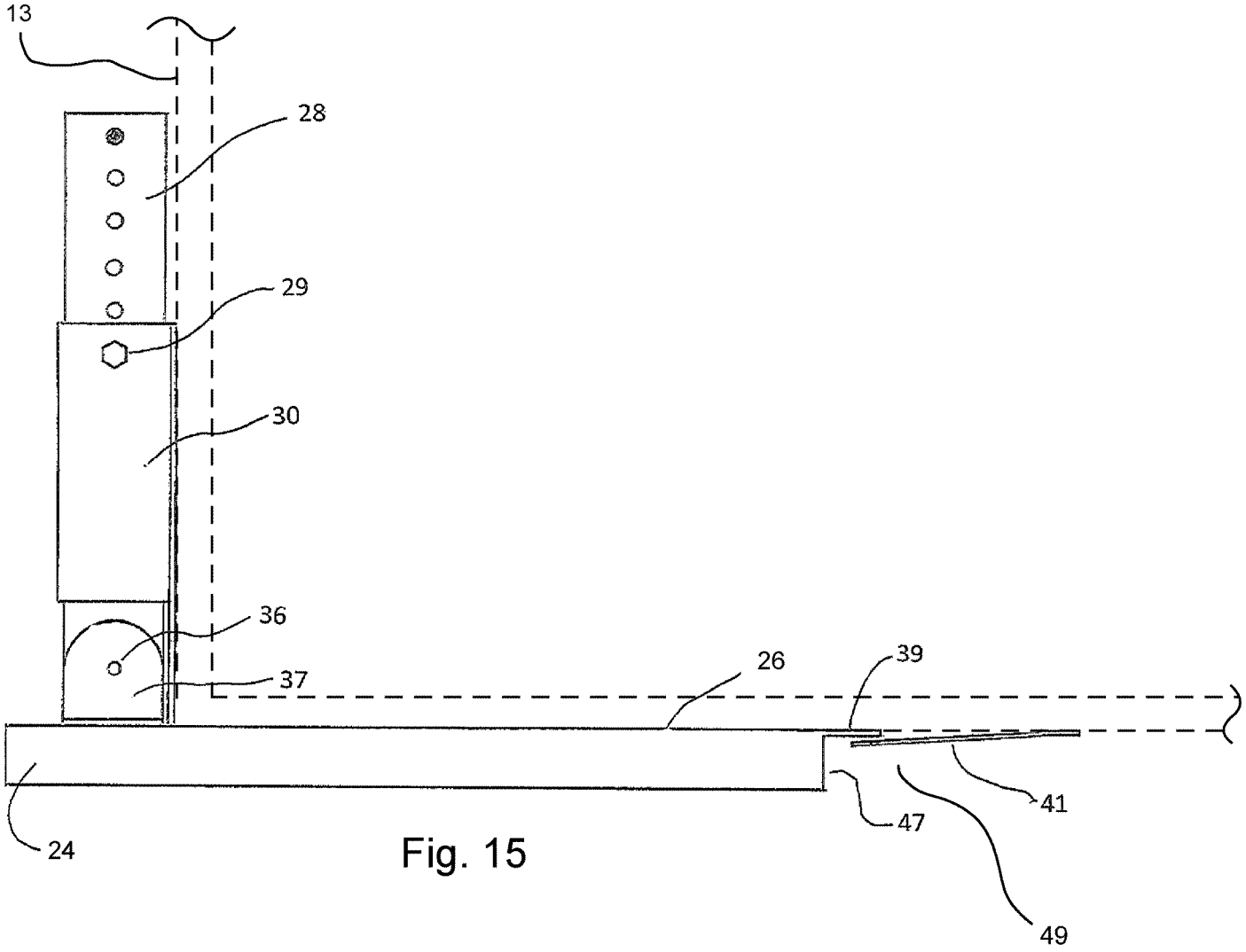
FIG. 15 is a side plan view of the embodiment of FIGS. 5, 6 and 11.

FIGS. 15 and 16 are a sequential view showing the operation of the actuation of the tab of the system. FIG. 17 is an enlarged view of the fluid hinge 49 portion of FIG. 16. Notice the relationship between the trim tab, the tongue 39, and the receiver 41. Here, there is ample space for the trim tab to move and slide freely. It is not fixed like the trim tabs of the prior art in Arnseson.

In a preferred embodiment, said tabs 26 are provided with downwardly directed sidewalls 40 (see FIGS. 10-11) which operate to enhance the stability of the present attitude control system. Said embodiment may, in certain applications, define a length as calculated for structural integrity.

Figure 9:
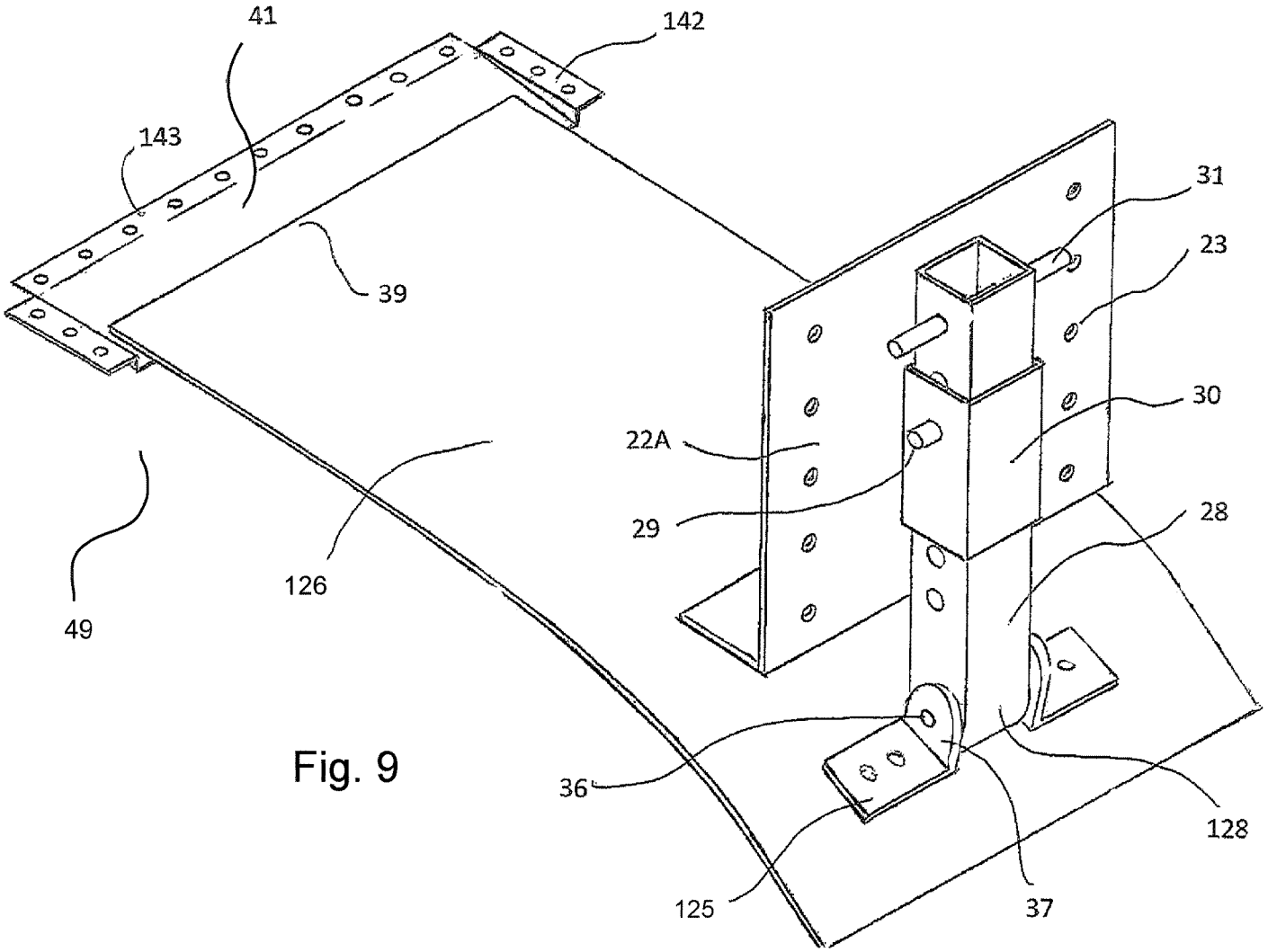
FIG. 9 is a top perspective view of the system of a flexible trim tab.
Figure 10:
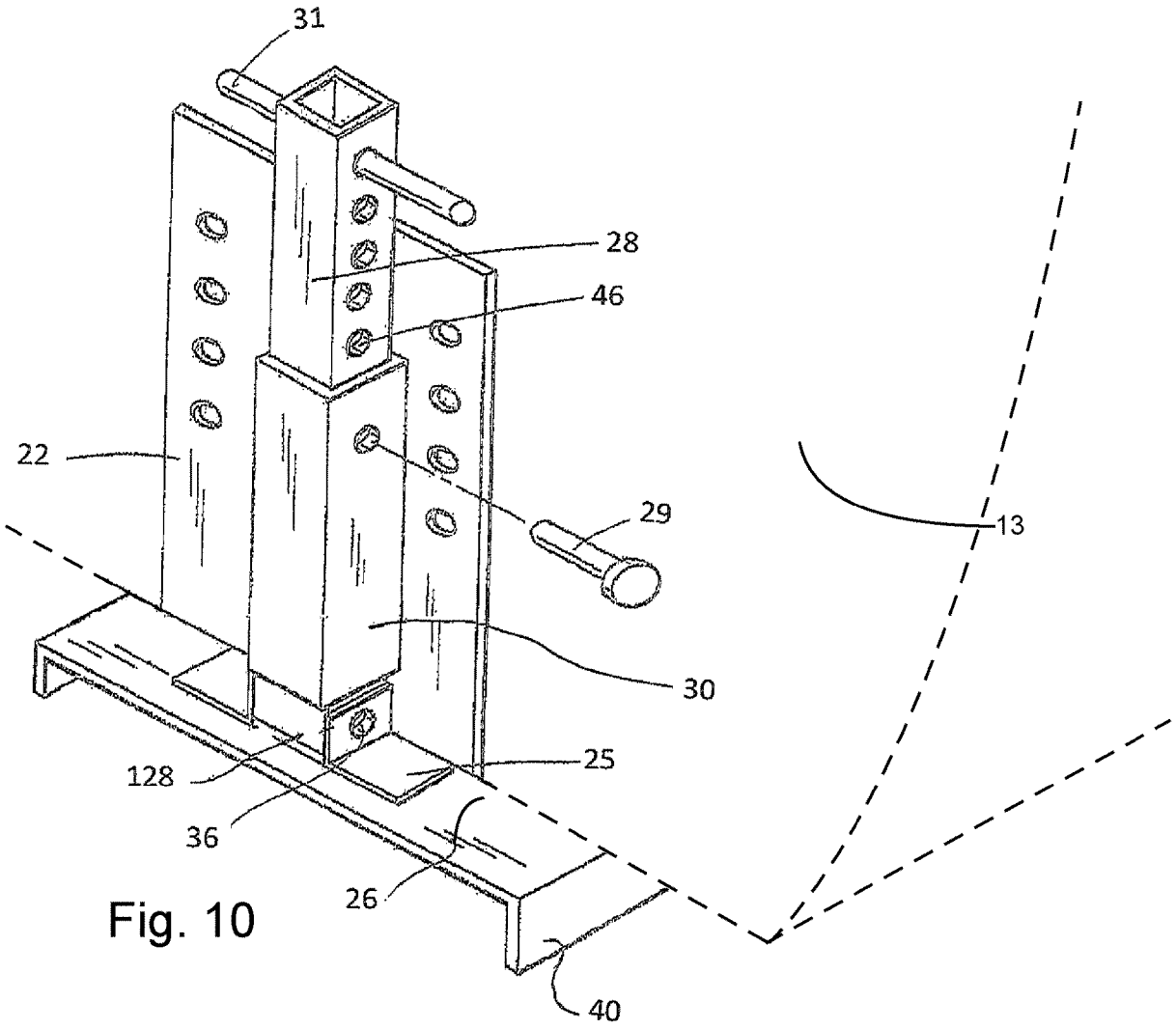
FIG. 10 is a perspective view of the system of FIGS. 5 and 6.
Figure 11:
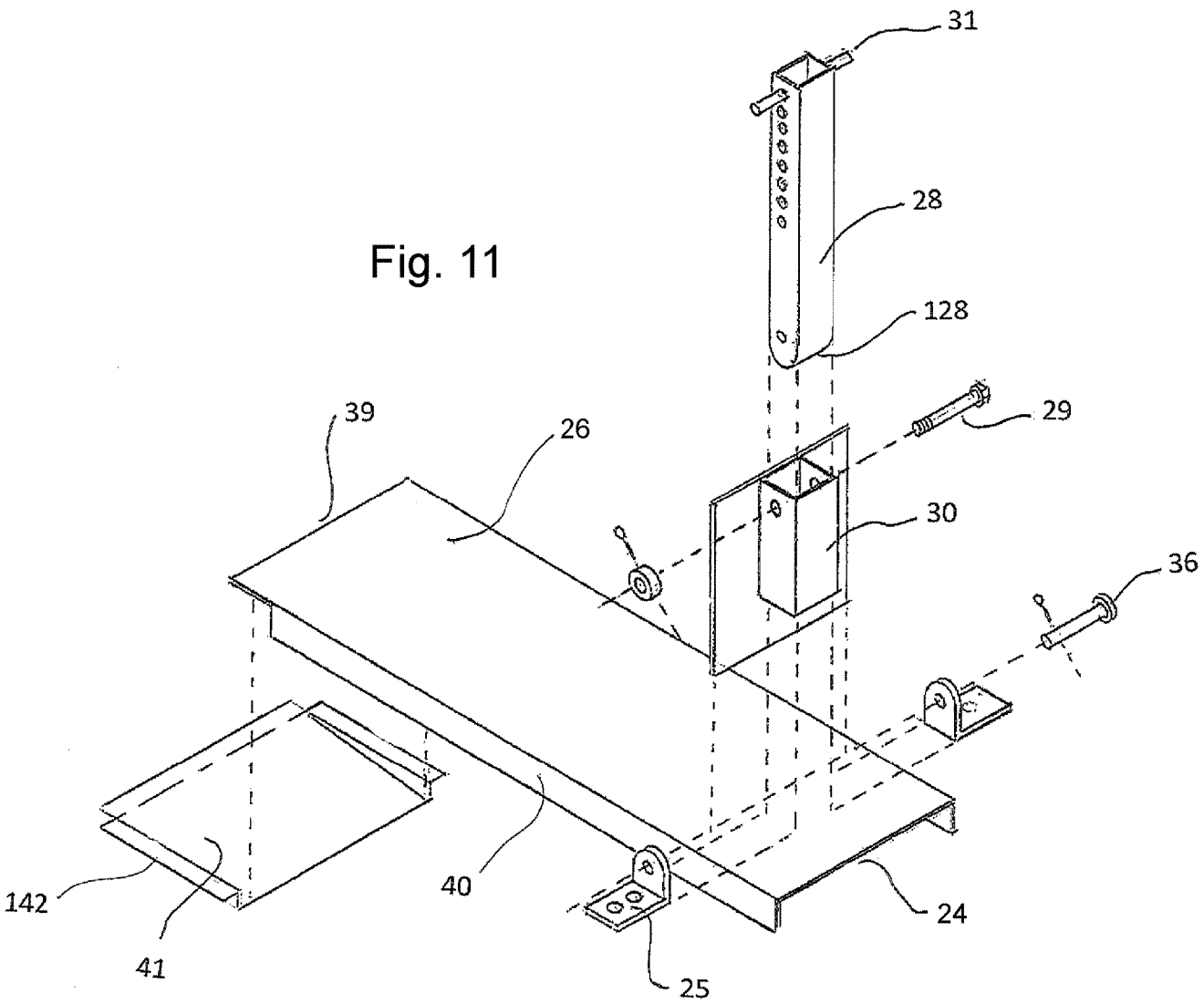
FIG. 11 is an exploded view of the system of FIGS. 5, 6, and 10.
Figure 13:
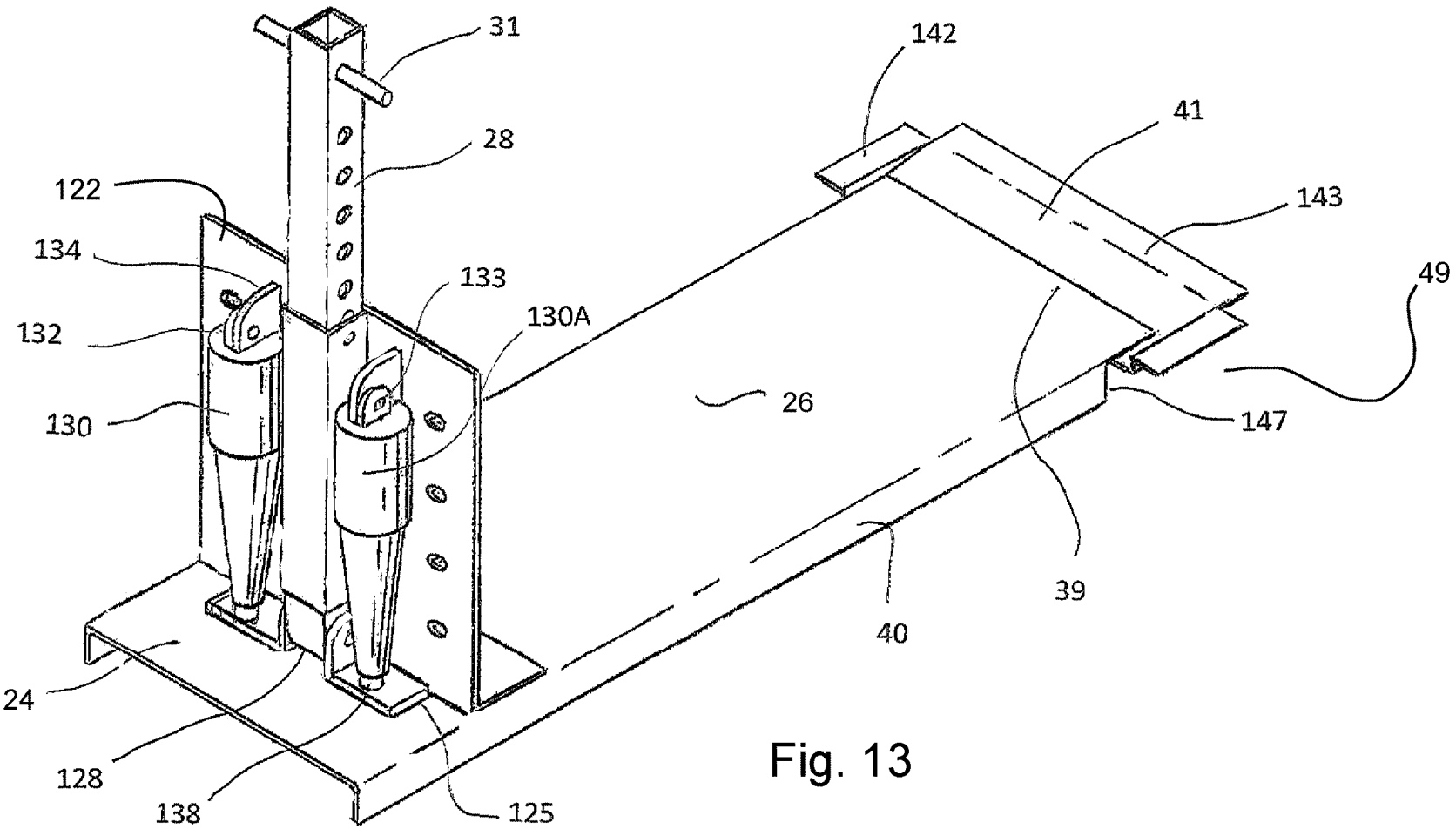
FIG. 13 is a perspective view showing or a manual actuator disposed between power actuators.

In accordance with the present invention, there are taught two basic embodiments of elongate planar attitude central surface 26, namely, the rigid embodiment as is shown in FIGS. 5, 11 and 13, and the flexible embodiment which is shown in FIG. 9. It is to be appreciated that in both elongate embodiments, the proximal portion 125 may operate with any combination of types of actuators, as is more fully described below.

In the present invention, the curvature of distal end 128 of actuator 28 plays an important role in the functioning of the attitude control surface 126, particularly in the flexible plate embodiment of the invention. More particularly, as may be seen in FIG. 9, the surface at end 128 is rounded to facilitate ease of contact with surface 126 with minimum obstruction against distal end 128 and upon said surface 126.

Further, actuator 28, as is shown FIGS. 6, 7, and 9-11, may be secured to said surface of the attitude control member by brackets 25 which are held to the distal end 128 of the actuator 28 by axle 36. See FIG. 9.

Figure 12:
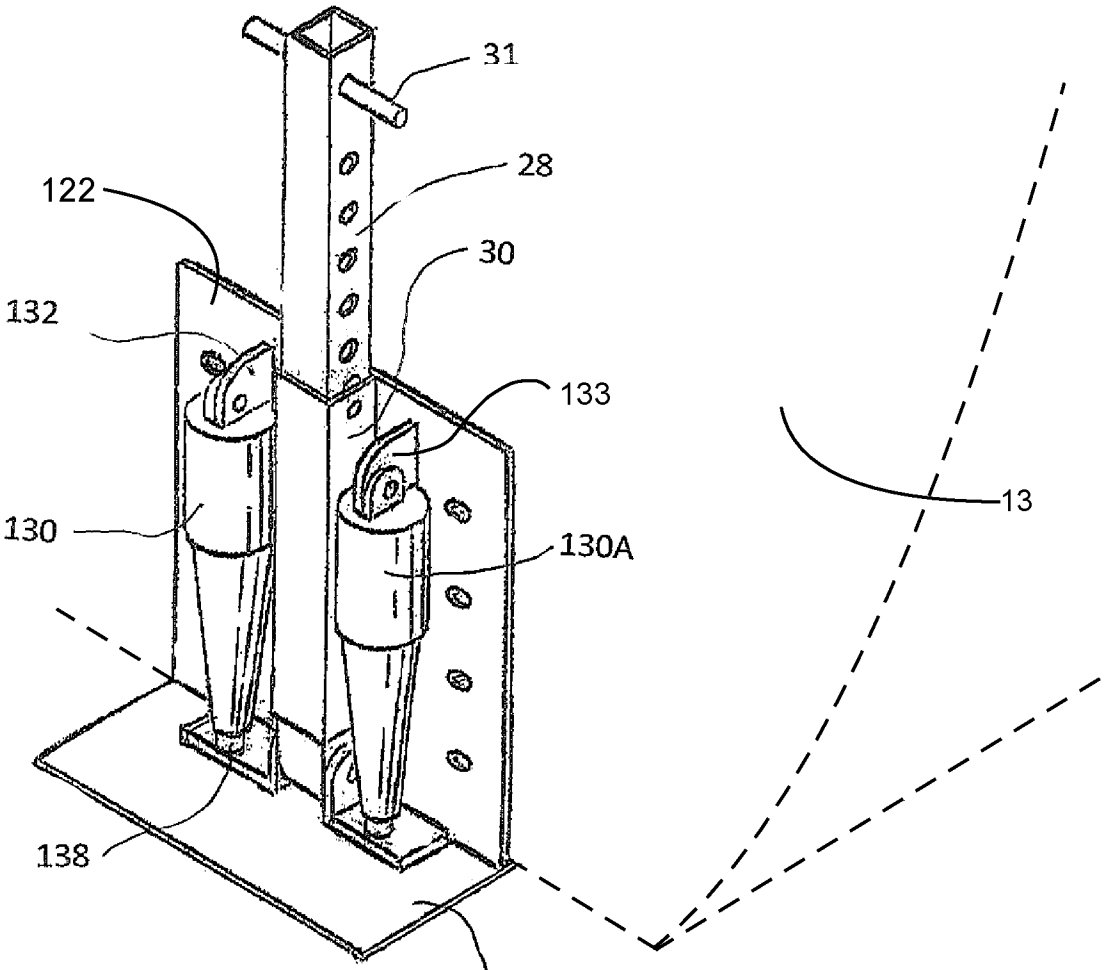
FIG. 12 is a perspective view showing a manual actuator in combination with a power actuator.

The present system also contemplates the selectable use of power actuators 130 (see FIGS. 12 and 13) which may be employed either separately or in combination with manual actuators as set forth above and shown in FIGS. 5, 6, 7, 10, and 11, and in FIG. 9. In many applications as, for example, is shown in FIGS. 12 and 13, it is useful to employ one or more power actuators in combination with a manual actuator. Therein, a single manual actuator is placed between two power actuators, that is, may be placed at either side of a manual actuator and held by plate 122, as is shown in FIGS. 12 and 13.

As may be appreciated, each power actuator, regardless of how employed, includes said extensible element 138 at an end of the power actuator 130 which uses internal means for power extension that may be either hydraulic or electrical. This strategy may be seen with reference to the embodiments of FIG. 12. Therein, if one wishes not to use the manual actuator, handle 31 thereof may simply be placed in a topmost position as for example is shown in FIGS. 12 and 13. Therein, the weight of gravity will assist power actuator 130 in its downward urging of proximal portion 24 of elongate attitude control surface 26.

Where two power actuators 130 and 130A are employed, one may employ brackets 125 secured to distal end 128 of the manual actuator to equalize the effect of possibly unequal extensions between elements 138 of each power actuator that otherwise might cause an imbalance upon the proximal portion 24 of elongate attitude control surface 26. See FIG. 13.

Figure 14:
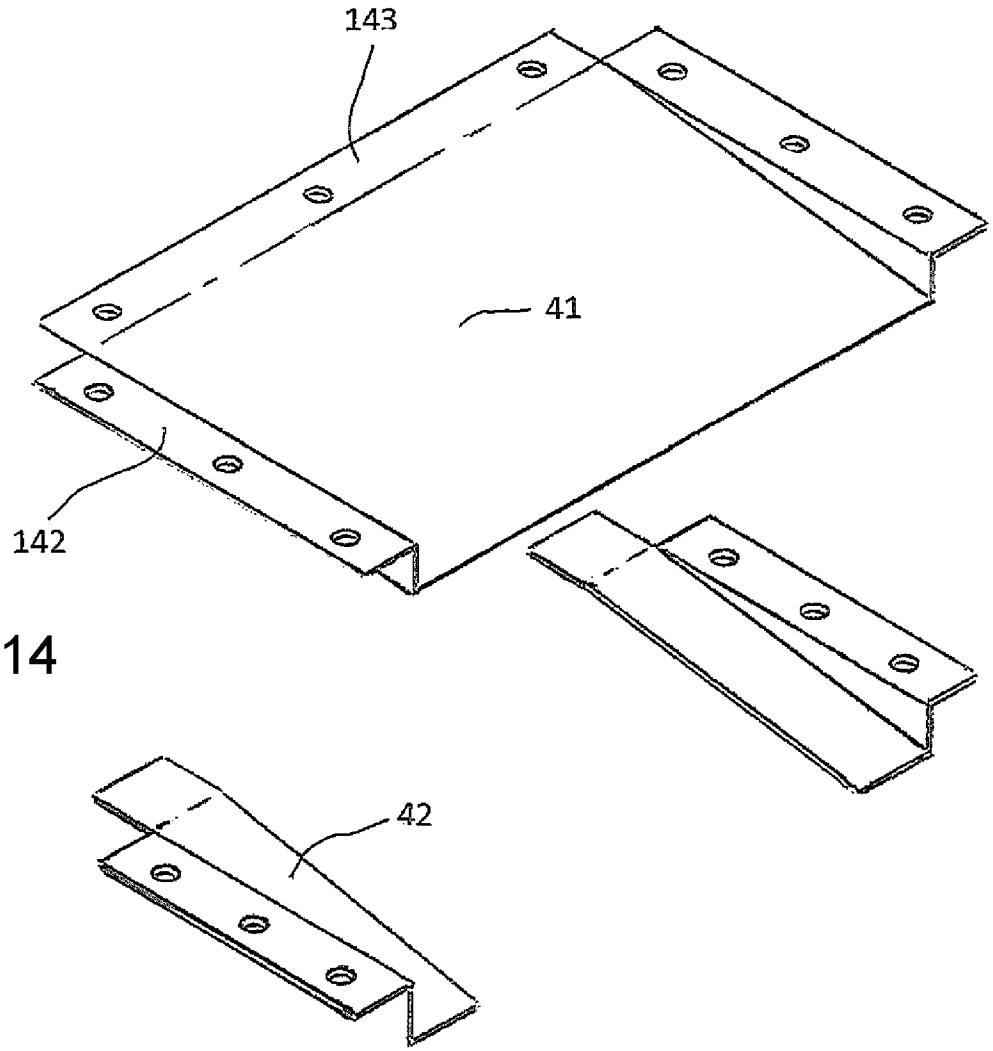
FIG. 14 is an exploded view showing two separate types of fluid hinge receiver assemblies.

FIG. 14 is a view of two embodiments of the receiver 41 of the present invention in which clip tabs 42 may be attached at the distal end 39 of attitude control surface 26. Alternatively, lateral elements 142 of receiver 41 may be secured to hull of the boat in the manner shown in FIG. 18 in which provide a more detailed view of the embodiment of FIGS. 5-7 in which the downward rotation of rigid attitude control surface 26 may be seen and, therewith, the extension of the actuator downwardly against proximal portion 24 of elongate attitude control surface 26. Therein may be seen the manner in which vertical distal surface 47 of elongate surface 26 facilitates insertion of its tongue element 39 into fluid hinge receiver 41 which in turn is secured to hull 20 of the boat. Moreover, the tab has the ability to have a void of space (see pocket 43) between any surface of the planar surface/trim tab and any other surface in the system. In other words, a hinge effect is accomplished by the structure shown more specifically in FIGS. 16 and 17 while proximal end 24 of elongate planar element 26 is able to rotate downwardly with the distal end of actuator 28 upon axle 36 to a depth in a range of about zero to a maximum of about 30 degrees. An enlarged view of the hinge area of FIG. 16 is shown in FIG. 17.

Figure 18:
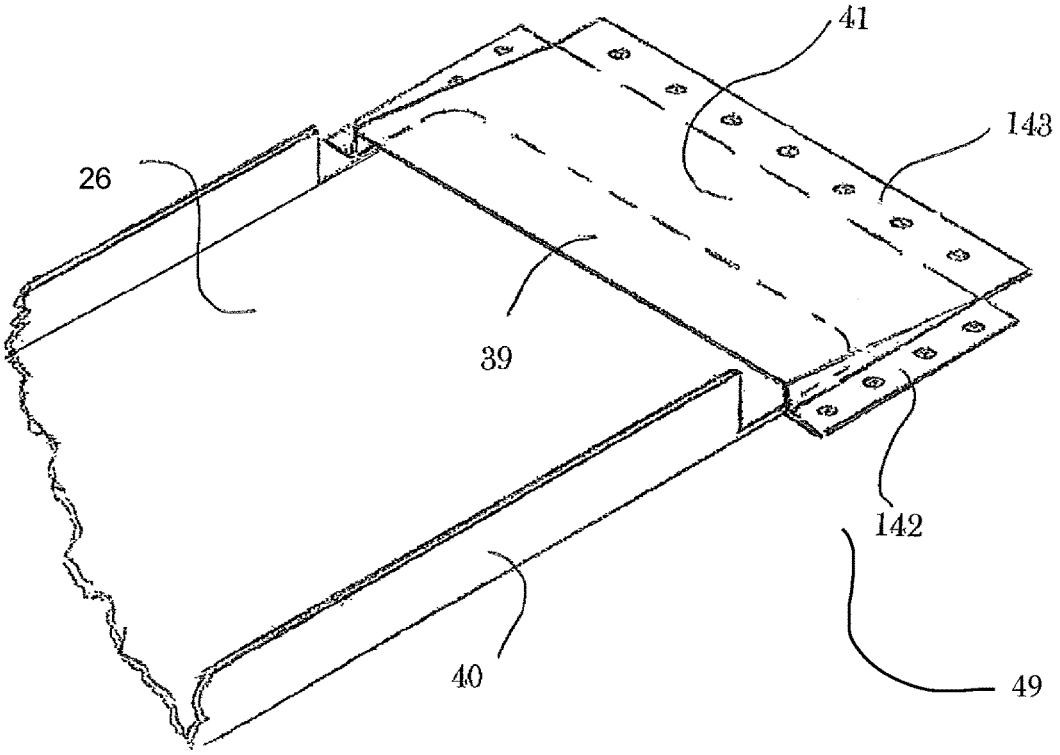
FIG. 18 is a perspective view of the bottom of the fluid hinge assembly.

In FIG. 18 is shown a bottom perspective view of fluid receiver 41 shown in FIGS. 9, 13-15, and 17. Notice that there is ample space located within the pocket 43, as shown in FIG. 17, for the planar surface to move and slide as needed. No bolts exist to fasten the planar surface. The only bolts that may be included in this invention would fasten the fluid hinge receiver 41 to the hull of a ship, but this would not be equivalent to fastening the tongue 39 to the ship, because there is a significant amount of space provided between the hull, and the surface of the fluid hinge receiver 41 for an unsecured trim tab to move and slide freely. The tab has the ability to have a void of space between any surface of the planar surface/trim tab and any other surface in the system. The only coupled connection is the actuator.

Figure 19:
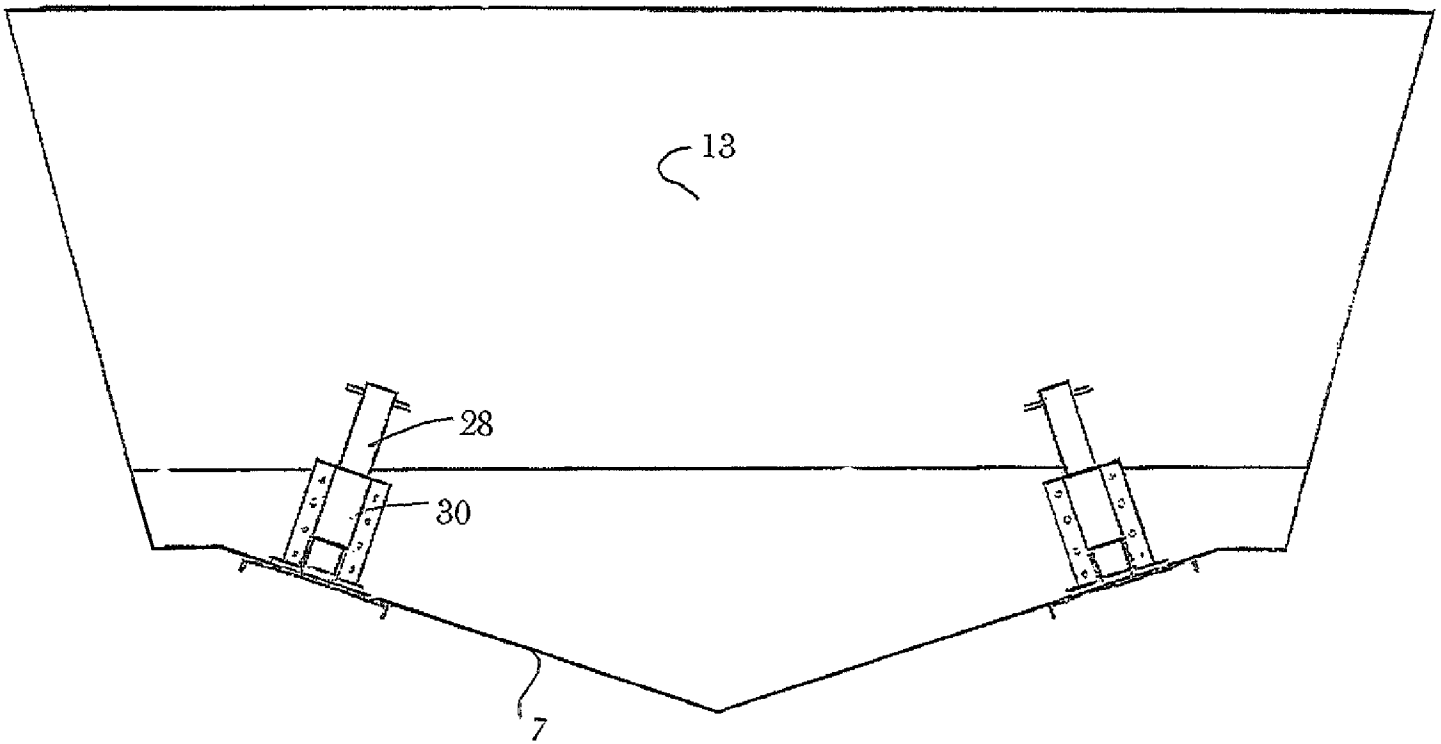
FIG. 19 is a rear elevational view of the first embodiment of the actuator of my system when installed upon a transom of a marine craft.

In FIG. 19 is illustrated the attachment of a manual embodiment of the present system, with one unit attached at opposite sides of hull 7 of the watercraft across the transom 13 thereof.

Figure 20:
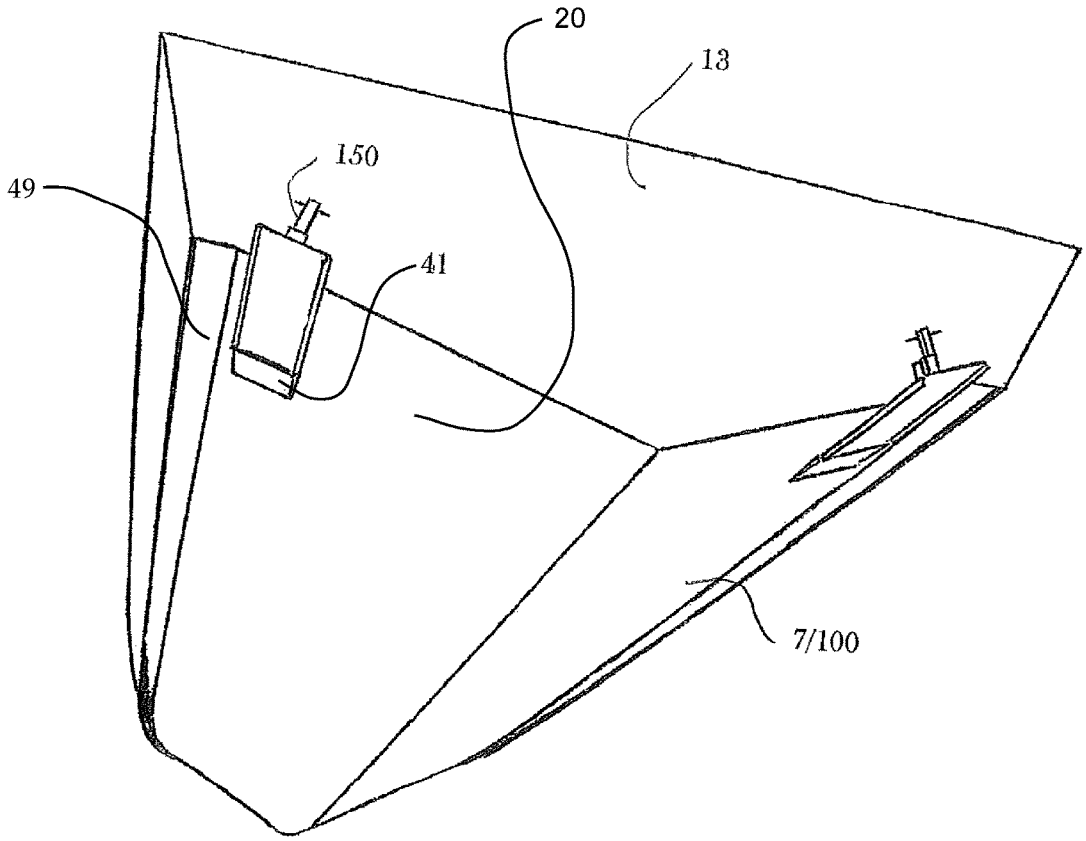
FIG. 20 is a rear elevational view of the planning surface and fluid hinge receiver of my system installed upon the stern area of the hull of a boat.

In FIG. 20 is shown the location of receivers 41 which may be secured to hull 20 of the marine craft. Actuator element 150 is also seen as secured to transom 13.

Figure 1:
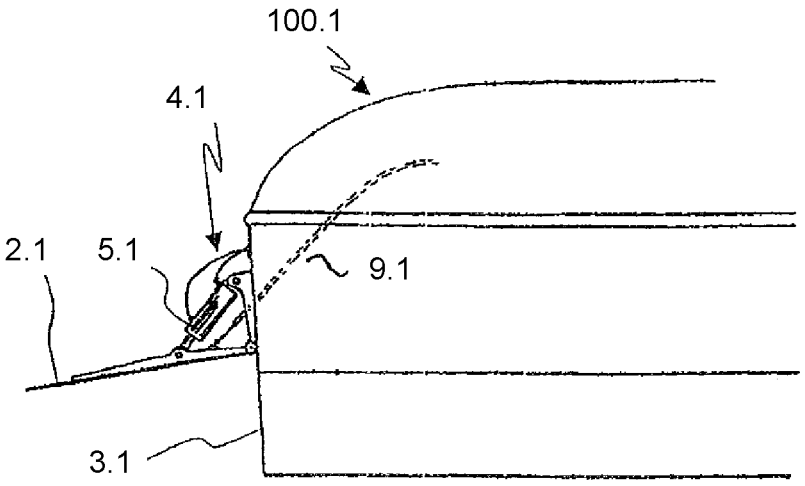
Fig. 1 (PRIOR ART)
FIG. 1 is a schematic view of one form of prior art trim tab system
Figure 2:
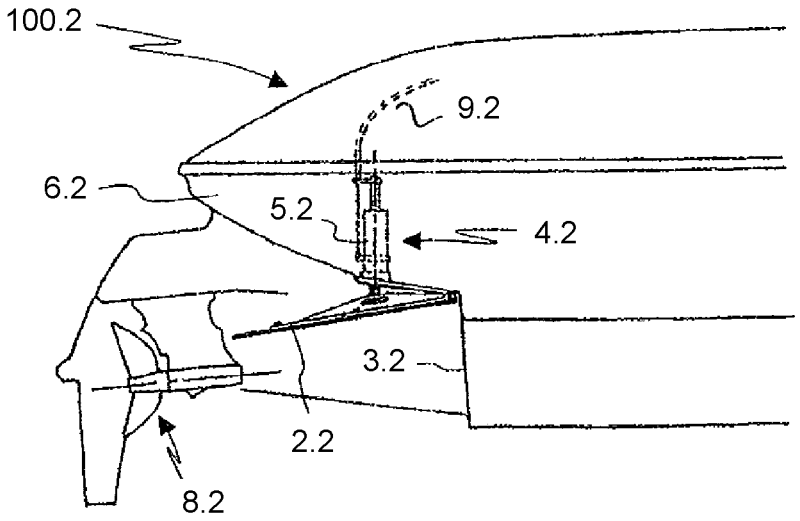
Fig. 2 (PRIOR ART)
FIG. 2 is a schematic view of a second form of prior art trim tab system.
Figure 3:
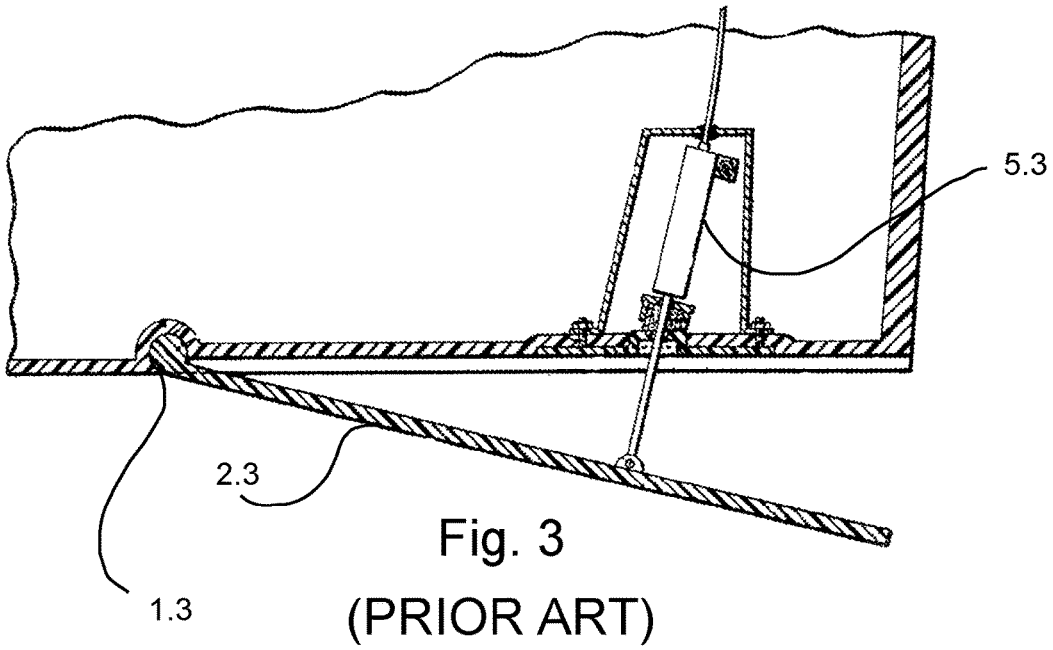
Fig. 3 (PRIOR ART)
FIG. 3 is a schematic view of a third form of prior art trim tab system.
Figure 4:
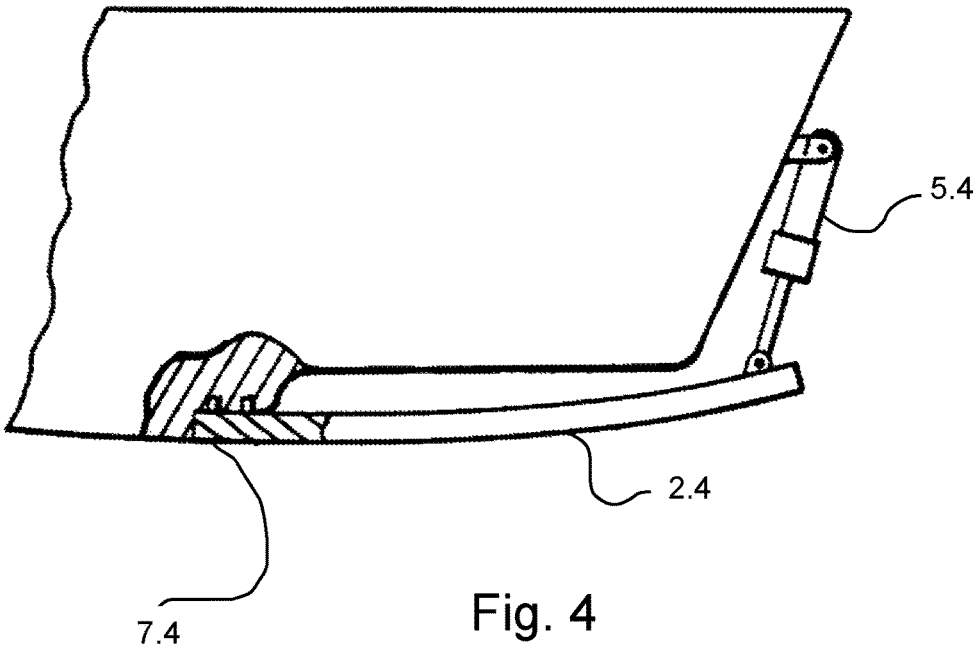
Fig. 4 (PRIOR ART)
FIG. 4 is a schematic view of a fourth form of prior art trim tab system.

It is to be further appreciated that the actuator assembly, as above described, may be positioned and secured internally to the hull in the manner shown in FIG. 2 or lower within the hull. Therein, the actuator is extensible beyond the hull of the boat to the proximal portion of the elongate planar surface 26.

Figure 21:
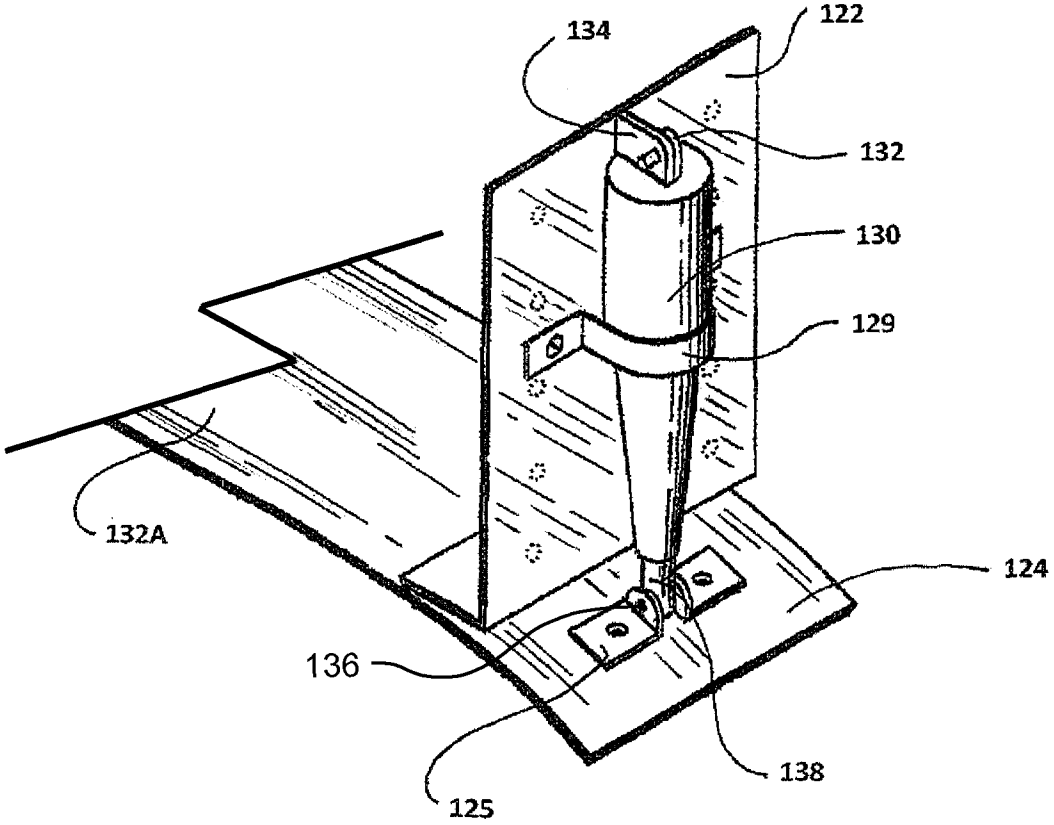
FIG. 21 is a perspective view of a power actuator showing a fixed pivot proximal end connection to a flexible tab.

FIG. 21 is a view of the power actuator 130 of a flexible trim tab in which proximal end 138 thereof is rotatably secured by axle 136 within brackets 125 of forward end 124 of flexible tab 132A. Also shown is transom plate 122, extension plates 132 and 134 of actuator 130 and axle 132 therebetween. A metallic strip 129 holds actuator 130 to transom plate 122.

Figure 22:
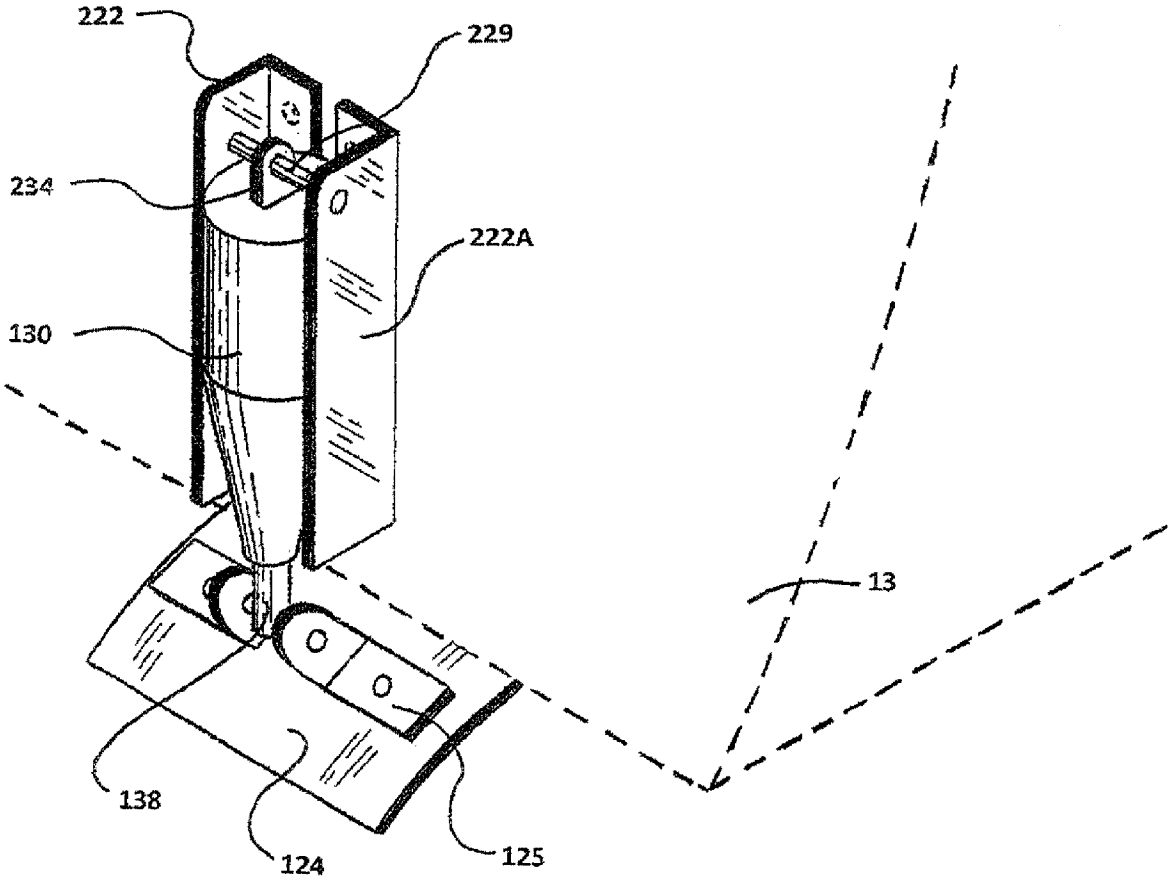
FIG. 22 is a view, similar to that of FIG. 21, but showing another form of securement of the power actuator to the transom.

FIG. 22 is a view, generally similar to that of FIG. 21, in which there are provided protective housings 222 and 222A which include axle 229 therebetween upon which distal element 124, depending from power actuator 130 may rotate while securing a distal end of the actuator 130. Also, in FIG. 21, proximal end 138 of the actuator is rotatably secured to aft end 124 of flexible tab 132A by brackets 125 and an axle 136 between said brackets.

Figures 7, 8:
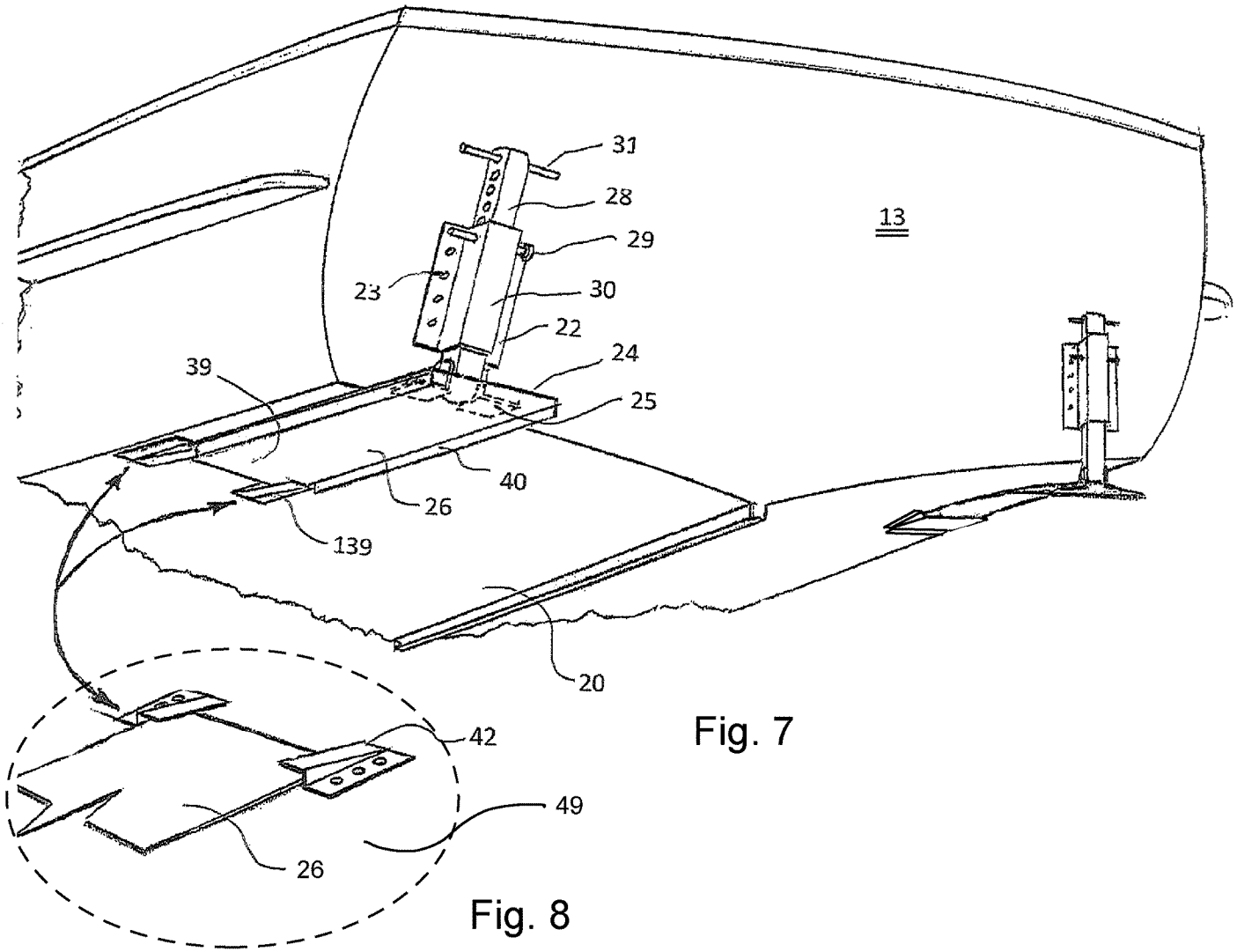
FIG. 7 is a perspective schematic partial exploded view of the present system installed upon the hull and transom of a marine craft.
FIG. 8 is an enhanced view of fluid hinge the trim tab of FIG. 7
Figure 23:
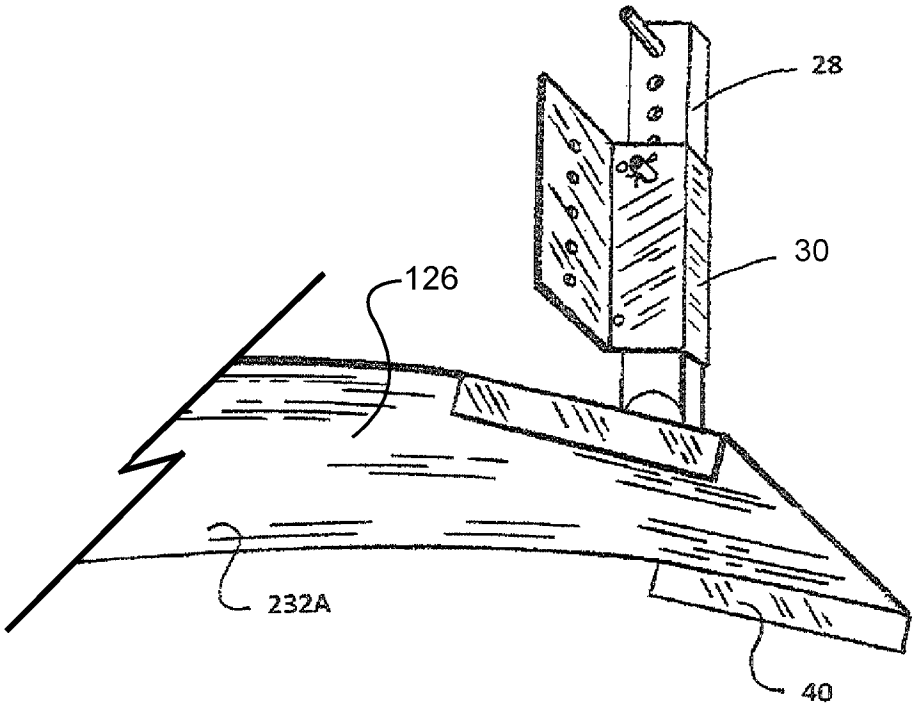
FIG. 23 is a lower perspective view of the manual actuator of FIGS. 5-7 including a flexible tab having sidewalls.

FIG. 23 is a lower perspective view showing a manual actuator 28 of the type of FIGS. 5-7 including guide and sidewalls 40 depending from planar surface 126 of tab 232A.

Figures 24, 24A:
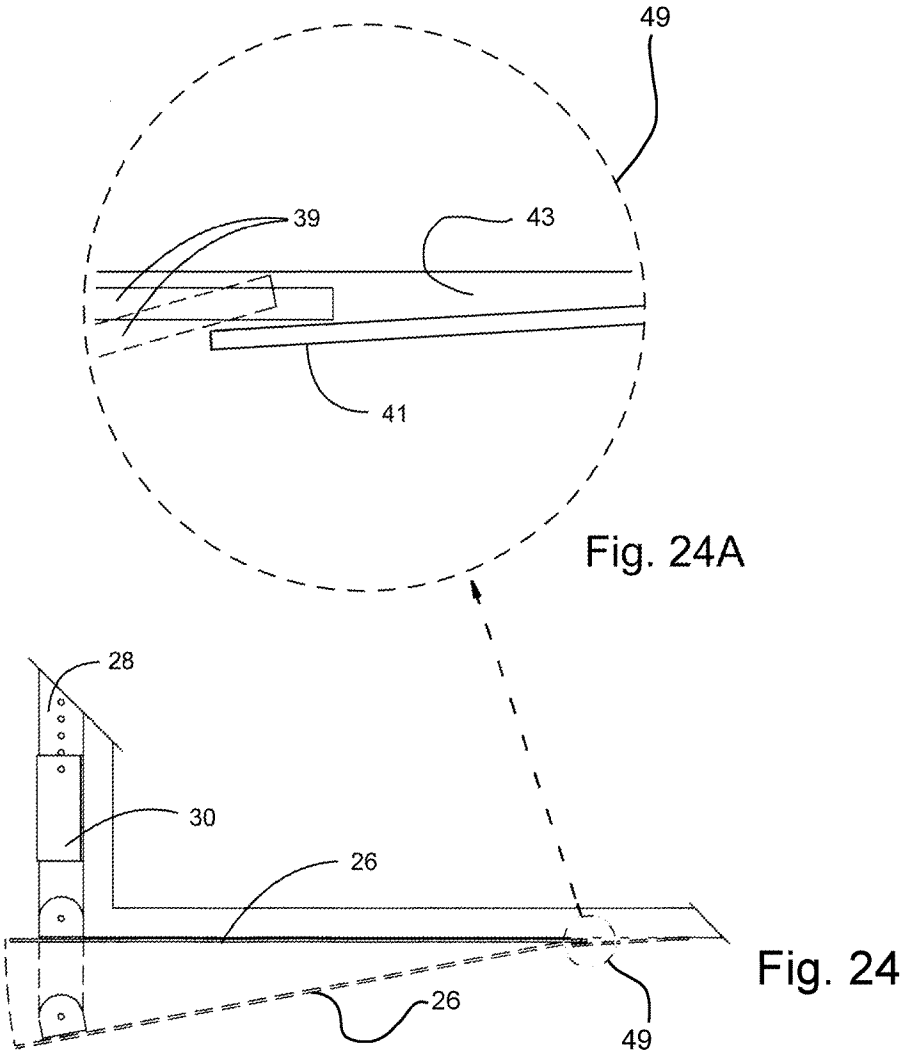
FIG. 24 is a conceptual side schematic view of a trim tab with a fluid hinge.
FIG. 24A is an enlarged conceptual side schematic view of the trim tab of FIG. 24 with a fluid hinge.

FIGS. 24 and 24A are a side schematic view of a trim tab using a fluid hinge 49 with a distal tongue-like element 39 and fluid hinge receiver 41 acting as a pocket 43 to contain the tongue-like element 39. The figure shows the motion needed to have a trim tab of the current invention.

Figure 25A:
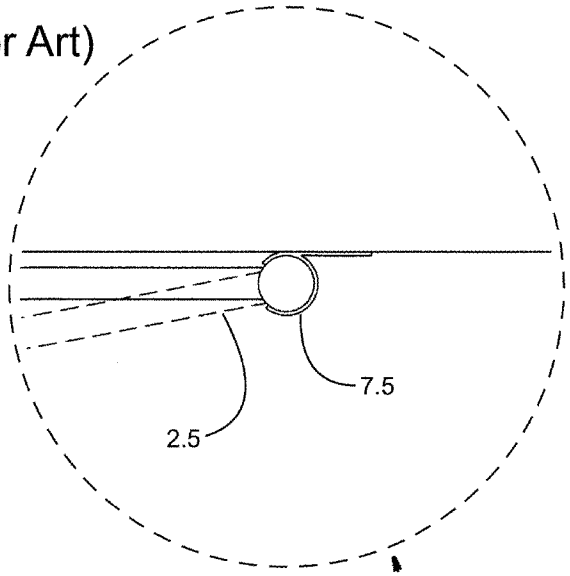
Fig. 25A (Prior Art)
FIG. 25A is an enlarged conceptual side schematic view of the trim tab of FIG. 25A with a pivot hinge of the prior art similar to FIG. 3.
Figure 25:
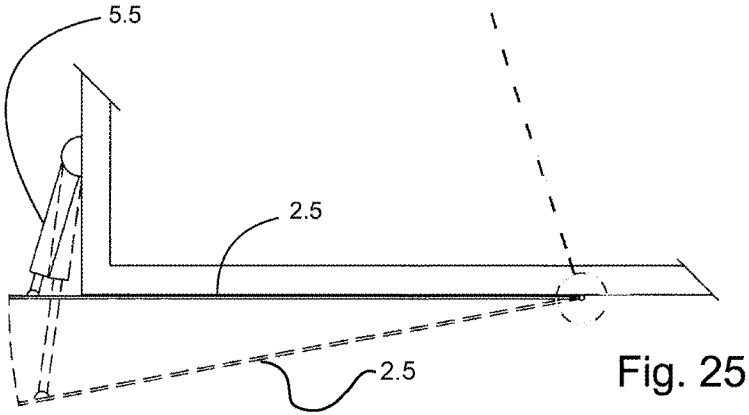
Fig. 25 (Prior Art)
FIG. 25 is a conceptual side schematic view of a trim tab with a pivot hinge of the prior art similar to FIG. 3.

FIGS. 25 and 25A are views similar to that of FIGS. 24 and 24A, but showing a trim tab as known in the prior art. FIGS. 25 and 25A show a pivot hinge 7.5, which keeps the planar surface 2.5 in a fixed location, and uses an actuator 5.5 mounted with a pivot to allow the actuator 5.5 to move, as a fixed actuator mounted at about a right angle would not work with a pivot hinge.

Figure 26:
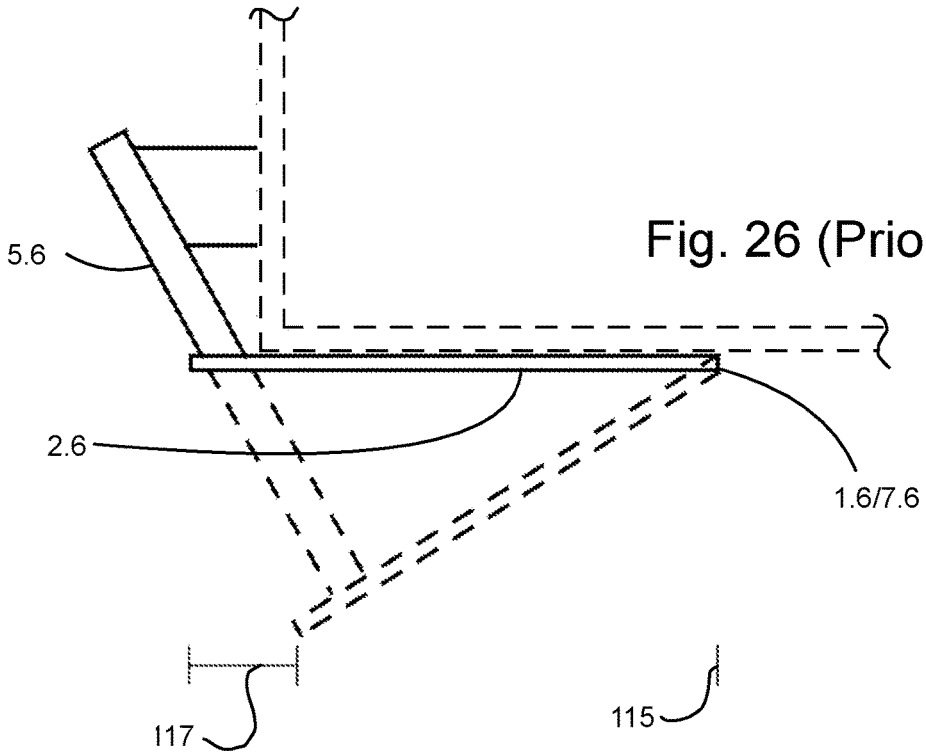
Fig. 26 (Prior Art)
FIG. 26 is a conceptual side view of a trim tab with a fixed hinge, similar to that of FIGS. 3 and 4.

FIG. 26 is a conceptual view of a trim tab similar to the prior art in Weiler (page 2). Notice that when the trim tab is lowered, the rear of the trim tab has a change in X distance 117. However, there is not change in the X distance 115 near the hinging element 7.6.

Figure 27:
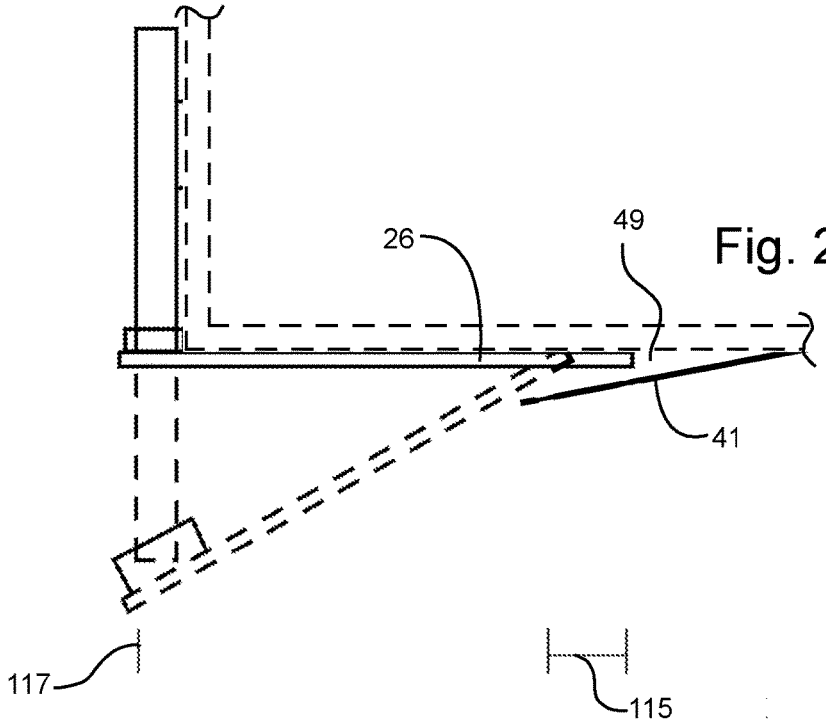
FIG. 27 is a conceptual side view of a trim tab with a fluid hinge similar to that as shown in FIGS. 17 and 24.

FIG. 27 is a conceptual view of a trim tab similar to this application, shown in its descended position. Notice that when the trim tab is lowered, the rear of the tab remains substantially in the same X axial location, but there is a shortening of a forward X distance 115 from the forward portion of the trim tab between the trim tab's raised and lowered positions. Further notice that the rear X distance 117 does not substantially change.

Figure 28:
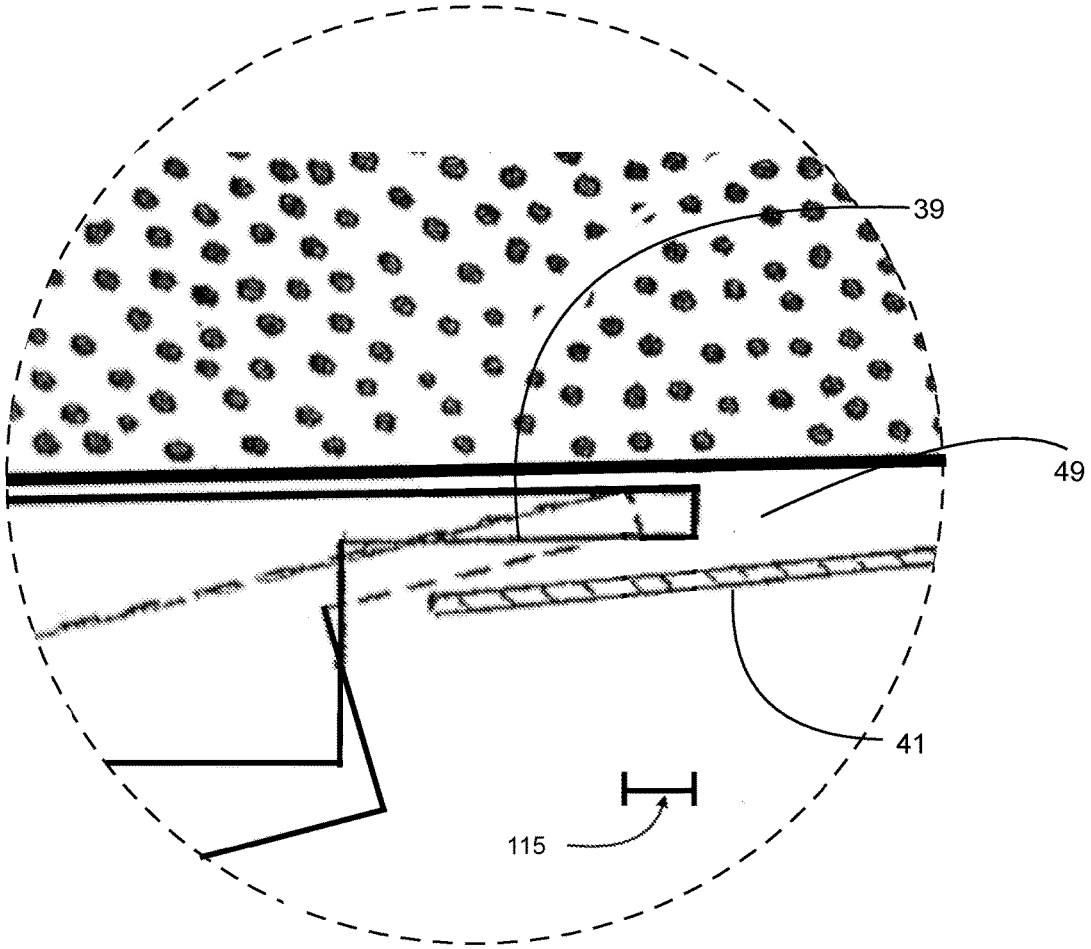
FIG. 28 is a zoomed in view of FIG. 17 showing the change in distance due to movement.

FIG. 28 shows the characteristics of that of FIG. 27, but applied to the embodiment illustrated in FIG. 17. Here, a difference in forward X distance 115 is also shown.

Figure 29:
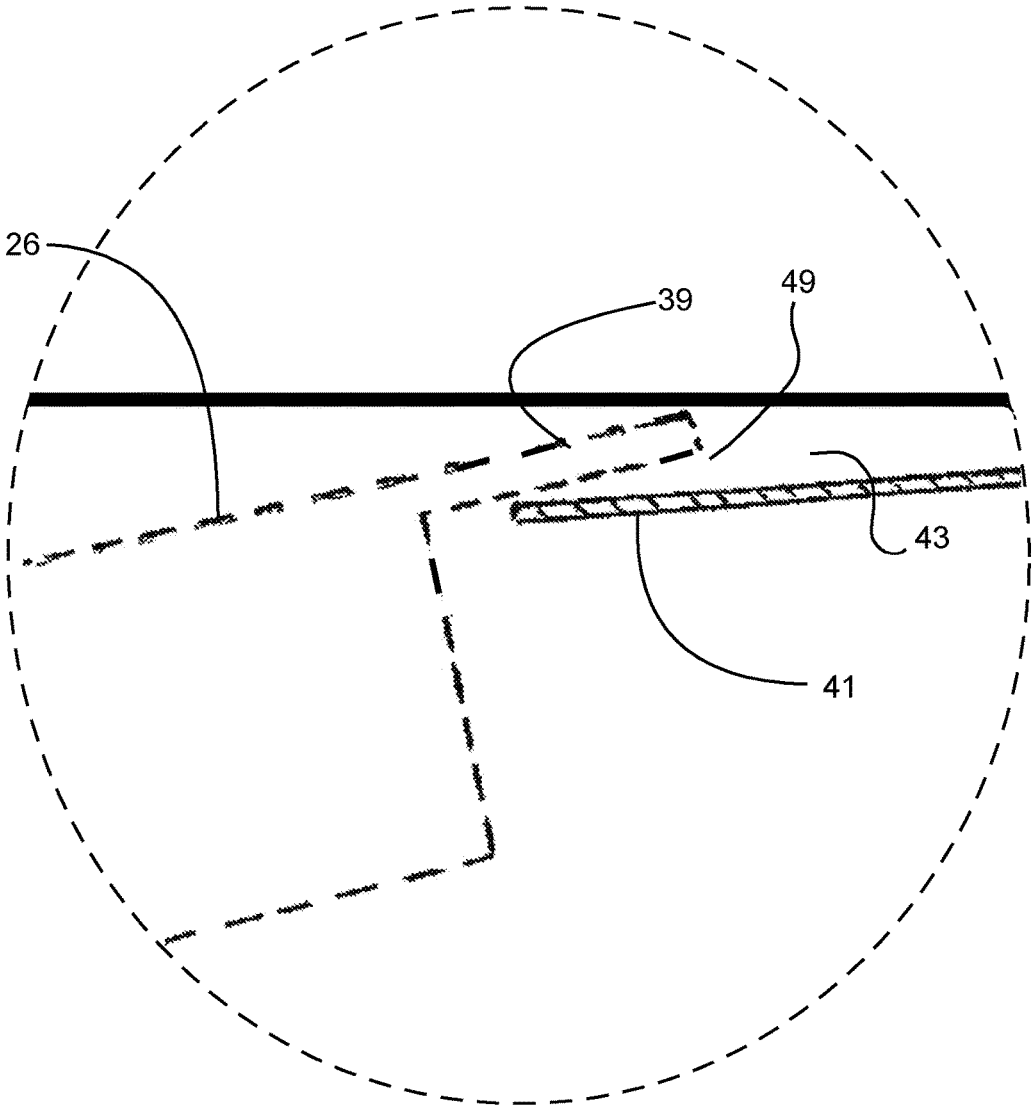
FIG. 29 is a zoomed in view of FIG. 17 isolating a view of the trim tab in its descended position.

FIG. 29, is a zoomed-in view of FIG. 17 isolating the view of the trim tab in its descended position. This shows the trim tab in its lowered position demonstrating the space around the tongue. Noticed the dotted line for an illustration of the trim tab in its descending position, and how the top and bottom are both detached from any surface.

FIG. 26 is a view similar to that of 27, but showing a trim tab with a fixed connection, such as in Arnseson and Weiler of the prior art. Notice that the hinging point is fixed, and thus, the change in X distance takes place at the aft portion of the trim tab. Further, because of its fixed hinge, the trim tab's actuator is shown to be mounted on an angle to allow the aft of the tab to descend, however, since the dissention exists on a radius, the actuator must be hinged as shown in FIG. 25, otherwise, the trim tab, as shown in Weiler, will be inoperable.

As noticed in all drawings in this application (example FIG. 17), the actuator is drawn at fixed about 90 degrees, but may be other angles, as long as the trim tab uses a fluid hinge 49. See FIGS. 24, 24A, and 27. However, most actuators cannot be fixed, because the hinging point is fixed as shown in an exaggerated view of FIG. 25. Further shown is a comparative example by viewing FIGS. 26 and 27. An actuator with a fixed mount must have a fluidly-connected hinge in order to allow movement and sliding of the planar surface of the trim tab. This is because of the planar surface's fixed length, and as the rear of the trim-tab moves down, the X-distance becomes shorter.

Additionally, shown in FIGS. 25 and 25A, if a hinge of the prior art is fixed, and the actuator is not mounted at a fixed an angle, the actuator may need the ability to pivot, and the fixed actuator described in this invention will not work as intended.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A system for attitude control and stabilizing of a marine craft, the system comprising:

(a) at least one elongate substantially planar surface disposed substantially in parallel with a bow-to-stern axis of one side of a bottom of a hull of the marine craft, said at least one elongate substantially planar surface further including a proximal actuatable portion at a stern end of said planar surface, said proximal portion extending from beneath said hull to beyond a transom of the craft;

(b) an actuator slidably positionable within a substantially vertical containment sleeve, said sleeve secured to a transom of said marine craft, a lower end of said actuator in selectable contact with said proximal portion of said at least one elongate substantially planar surface;

(c) a means for selectably advancing said actuator within said sleeve against said proximal portion of said planar surface to define a planing angle of said at least one substantially elongate planar surface relative to said one side of said hull of the marine craft to which it is secured;

(d) a distal end of each elongate planar surface each defines a tongue-like element slidably captured as a fluid hinge upon a region of said hull of the craft, said tongue like element slidably moveable both up and down and forward and aft;

(e) said fluid hinge having a male and a female element of engagement, wherein said female element comprises a fluid hinge receiver acting as a pocket to capture a distal end of each said at least one elongate substantially planar surface, and said male element comprises the distal end of each said at least one elongate substantially planar surface;

(f) said pocket containing the distal end of each said at least one elongate substantially planar surface close to the hull; and (g) said distal end of each said at least one elongate substantially planar surface lacking a physical fastening to the hull.

2. The system as recited in claim 1, further comprising:

(h) said distal end of each said at least one elongate substantially planar surface having forward slidability and aft slidability substantially within said pocket.

3. The system as recited in claim 1, in which a range of adjustment of said at least one elongate substantially planar surface relative to the axis of the bottom of the hull of the marine craft is in a range of about zero to a maximum of about 30 degrees.

4. The system as recited in claim 1, further comprising a stop limit to preclude over extension of said actuator relative to said actuation sleeve.

5. The system as recited in claim 1, in which a transverse cross-section of said actuator and sleeve each define a square or rectangle.

6. The system as recited in claim 1, in which a traverse cross-section of said actuator and sleeve each define a circle.

7. The system as recited in claim 1, in which a transverse cross-sectional of said elongate planar surface defines an inverted letter "U" at the proximal region of said elongate surface.

8. The system as recited in claim 1, in which said at least one elongate substantially planar surface comprises a rigid material.

9. The system as recited in claim 8, said at least one elongate substantially planar surface comprises:

downwardly directed integral side edge elements substantially along an entire length of said at least one elongate substantially planar surface.

10. The system as recited in claim 1, in which said at least one elongate substantially planar surface comprises a flexible material.

11. The system as recited in claim 1, in which said actuator comprises a power actuator.

12. The system as recited in claim 1, in which said actuator comprises at least one manual and hydraulic actuators mounted together with each other.

13. The system as recited in claim 1, in which said fluid hinge defining pocket defines a location of between about 2 feet and about 8 feet forward of the transom.

14. The system as recited in claim 1, in which the at least one elongate substantially planar surface comprises two planar surfaces in which one planar surface is mounted on a port side and one planar surface is mounted on a starboard side.

* * * * *